US007460028B2

(12) United States Patent
Garibotto et al.

(10) Patent No.: US 7,460,028 B2
(45) Date of Patent: Dec. 2, 2008

(54) VEHICLE LICENCE PLATES MONITORING SYSTEM

(75) Inventors: Giovanni Garibotto, Varazze (IT); Paolo Castello, Genoa (IT); Enrico Del Ninno, Genoa (IT)

(73) Assignee: ELSAG S.p.A., Genoa (IT)

( * ) Notice: Subject to any disclaimer, the term of this patent is extended or adjusted under 35 U.S.C. 154(b) by 372 days.

(21) Appl. No.: 10/528,375

(22) PCT Filed: Sep. 19, 2003

(86) PCT No.: PCT/IT03/00558

§ 371 (c)(1),
(2), (4) Date: Jan. 5, 2006

(87) PCT Pub. No.: WO2004/027730

PCT Pub. Date: Apr. 1, 2004

(65) Prior Publication Data

US 2006/0164258 A1 Jul. 27, 2006

(30) Foreign Application Priority Data

Sep. 20, 2002 (IT) ..... TO2002A0827

(51) Int. Cl.
*G08B 1/107* (2006.01)

(52) U.S. Cl. ..... 340/937; 340/936; 340/901; 340/905; 340/933; 340/932.2; 340/425.5; 340/539.11; 340/539.16; 348/148; 348/149; 701/35; 701/36

(58) Field of Classification Search ..... 340/937, 340/936, 901, 905, 425.5, 539.11, 539.16, 340/933, 932.2; 348/148, 149; 701/35, 36
See application file for complete search history.

(56) References Cited

U.S. PATENT DOCUMENTS

| | | | | |
|---|---|---|---|---|
| 4,591,823 | A | 5/1986 | Horvat | |
| 5,568,406 | A * | 10/1996 | Gerber | 702/159 |
| 6,188,939 | B1 * | 2/2001 | Morgan et al. | 701/36 |
| 6,262,764 | B1 | 7/2001 | Perterson | |
| 6,384,740 | B1 | 5/2002 | Al-Ahmed | |
| 6,433,706 | B1 | 8/2002 | Anderson, III et al. | |

FOREIGN PATENT DOCUMENTS

WO WO-96 11458 A 4/1996

* cited by examiner

*Primary Examiner*—Tai Nguyen
(74) *Attorney, Agent, or Firm*—Fitch, Even, Tabin & Flannery; Norman N. Kunitz

(57) ABSTRACT

A territorial surveillance and/or security control system based on monitoring vehicle license plates, and having a number of mobile surveillance units (2) for reading vehicle license plates and generating alarms during patrol by the mobile surveillance units (2), and a permanent surveillance centre (3) communicating with the mobile surveillance units (2) to locate the mobile surveillance units by radio, to gather, file, and consult the license plates detected by the mobile surveillance units (2), to handle the alarms generated by the mobile surveillance units, and to update a list of wanted license plates. Each mobile surveillance unit (2) includes a vehicle (4) equipped with an on-vehicle navigation system (5); and a license plate reading device (6) on the vehicle (4) and communicating with the on-vehicle navigation system (5) of the vehicle (4), which controls communication with the permanent surveillance centre (3) to update the list of wanted license plates, and to transmit any alarms generated by the mobile surveillance unit (2).

11 Claims, 3 Drawing Sheets

VEHICLE LICENCE PLATES MONITORING SYSTEM

CROSS REFERENCE TO RELATED APPLICATION

This application is the National Stage filing under 35 U.S.C. 371 of International Application No. PCT/IT03/00558, filed Sep. 19, 2003, and claims priority of Italian Patent Application TO2002A000827, filed Sep. 20, 2002, the subject matter of which, in its entirety, is incorporated herein by reference.

TECHNICAL FIELD

The present invention relates to a territorial surveillance and/or security control system based on monitoring vehicle license plates.

BACKGROUND ART

Vehicle license plate monitoring is used in a wide range of applications, foremost of which include: local (e.g. city) traffic speed control; controlling access to supervised areas (e.g. parking lots) or restricted traffic areas (RTA); road pricing; and highway security control, e.g. monitoring traffic through automatic toll systems (telepass), service areas, etc.

Vehicle license plates can be monitored using either portable devices, e.g. installed in vehicles or along the edge of the road, or permanent devices, e.g. installed overhead on poles close to the road.

Though greatly improved, territorial security control systems based on monitoring vehicle license plates still leave room for further improvement.

DISCLOSURE OF INVENTION

It is an object of the present invention to provide an even further improved territorial surveillance and security control system based on monitoring vehicle license plates.

According to the present invention, there is provided a territorial surveillance and/or security control system as claimed in claim 1.

BRIEF DESCRIPTION OF THE DRAWINGS

A preferred, non-limiting embodiment of the invention will be described by way of example with reference to the accompanying drawings, in which.

BEST MODE FOR CARRYING OUT THE INVENTION

Figure 1:
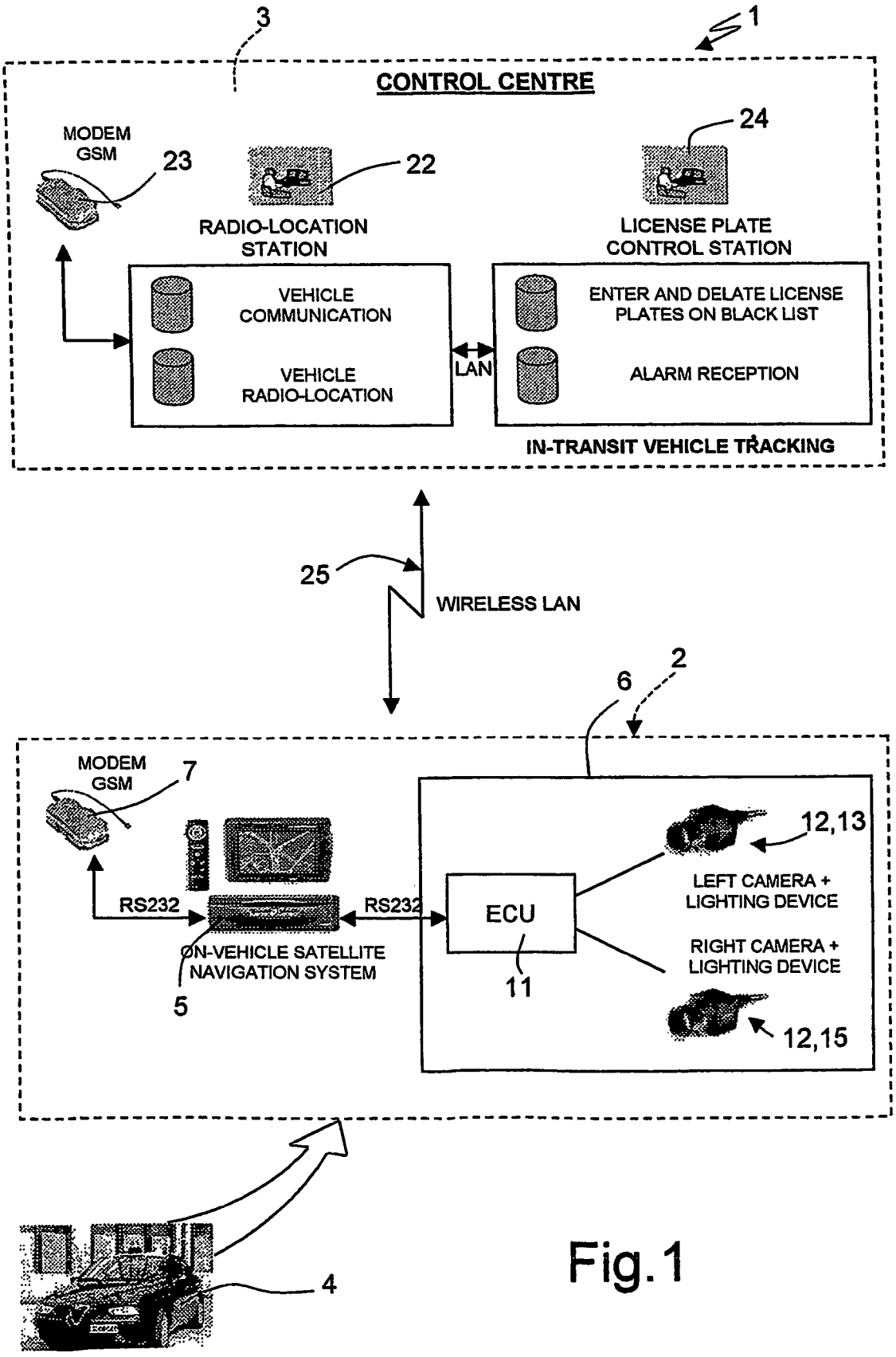
FIG. 1 shows a block diagram of a territorial surveillance and/or security control system in accordance with the present invention.

Number 1 in FIG. 1 indicates as a whole a territorial surveillance and/or security control system in accordance with the present invention.

System 1 substantially comprises:

- a number of mobile surveillance units—hereinafter referred to simply as Patrols 2—for reading vehicle license plates and generating alarms; and
- a permanent remote surveillance centre—hereinafter referred to simply as Control Centre 3—which communicates by radio with Patrols 2 to locate Patrols 2; to update the wanted-plate list; to gather, file, and consult the license plates reported by Patrols 2; and to handle Patrol-generated alarms.

More specifically, each Patrol 2 comprises a car 4 —in this case, a police car—equipped with an on-vehicle navigation system 5; and a license plate reading device 6 on car 4 and communicating with on-vehicle navigation system 5, which controls on-line communication with Control Centre 3, displays, on its own display, the on-patrol license plate readings taken by Patrol 2, and transmits any alarms (wanted-vehicle license plates).

More specifically, license plate reading device 6 may, for example, be connected to on-vehicle navigation system 5 via an RS 232 serial port, and on-vehicle navigation system 5 communicates by radio with Control Centre 3 via a GSM/GPRS module 7, to which it can be connected via an RS 232 serial port.

Figure 2:
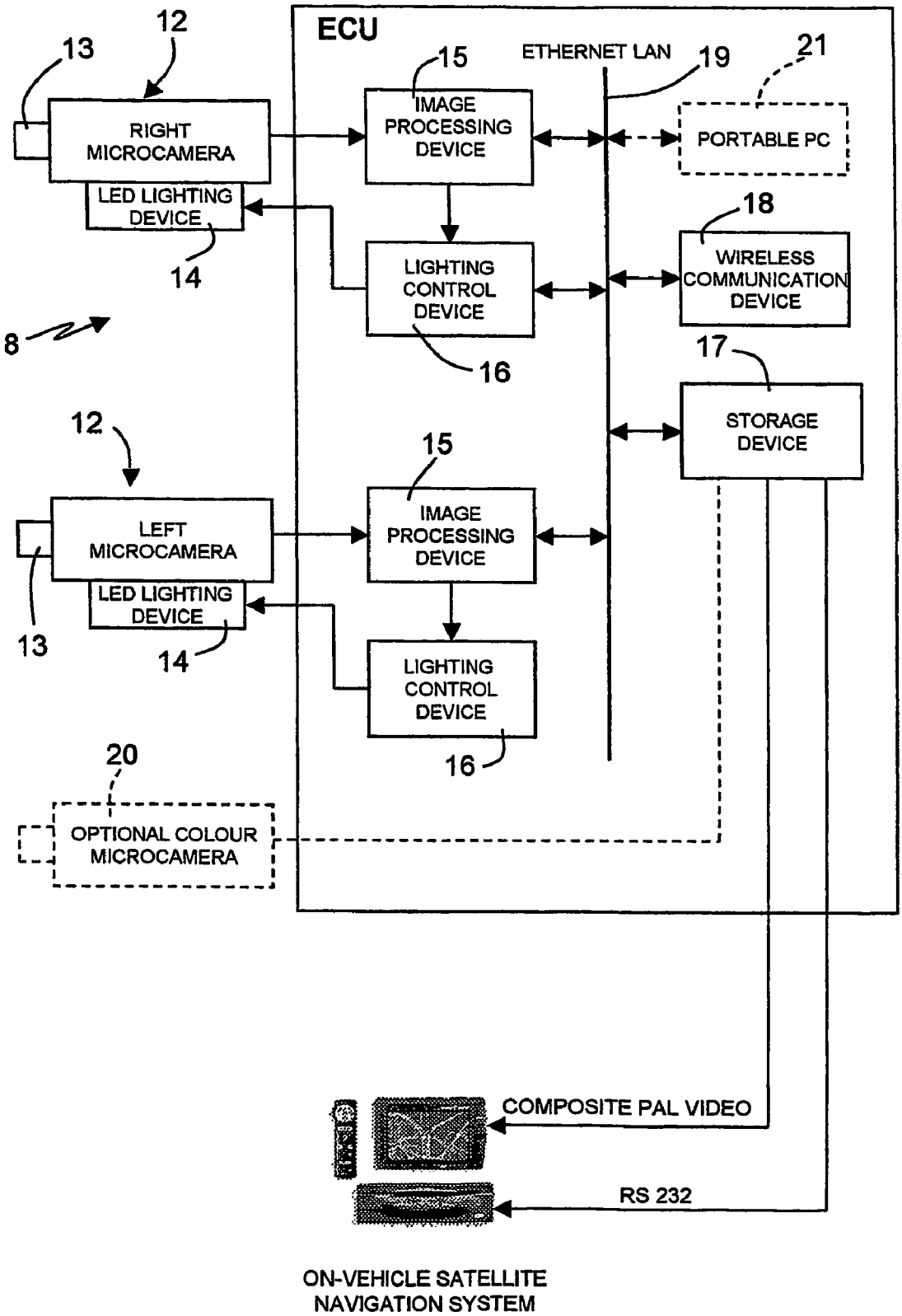
FIG. 2 shows an architectural diagram of a license plate reading device forming part of the FIG. 1 system.
Figure 3:
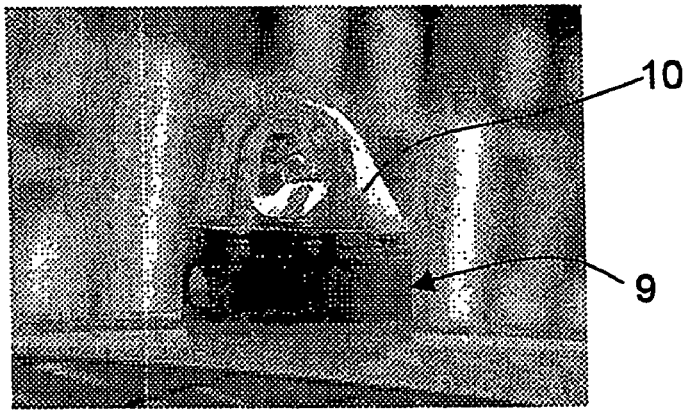
FIG. 3 shows a preferred arrangement of a binocular sensor device forming part of the FIG. 2 license plate reading device.

With reference also to FIGS. 2 and 3, each license plate reading device substantially comprises an integrated miniaturized binocular sensor device 8 housed in a cylindrical housing 9 (FIG. 3) fitted to the roof of the Patrol 2 vehicle and so sized as not to affect the functional characteristics of car 4; and an on-vehicle processing unit (ECU) 11 connected to binocular sensor device 8 and housed, for example, in the boot (not shown) of car 4.

Binocular sensor device 8 substantially comprises two—one right and one left—digital microcameras 12 for picking up vehicle license plates to the right and left of Patrol 2, and each having an optical filter 13 in the close-to-infrared spectrum, which attenuates light, even in full-sun conditions, but provides for greater stability when taking automatic readings. To ensure accurate image pickup and reading in any external lighting conditions—which, as is known, vary widely and unpredictably from a few lux in the shade, in tunnels, and at night, to over 100 Klux with full sun at the rear—each microcamera is provided with a LED lighting device 14, which is pulse-operated with very short, programmable exposure times, and is synchronized with the acquisition system of relative digital microcamera 12.

The flash emitted by LED lighting device 14 is therefore simultaneous with and of the same duration as the exposure time of digital microcamera 12 to ensure maximum pickup efficiency; the beam emitted by LED lighting device 14 is selected in the close-to-infrared range to reduce ambient light interference, and solutions with 730 and 810 nanometer LED's are possible.

To ensure license plate reading device 6 operates correctly in any external light condition, the operating brightness level of each digital microcamera 12, i.e. the brightness level at which an image is acquired by each microcamera 12, is varied cyclically between three operating conditions:

low light and backlighting;
medium (diffused) light;
strong light (reflections and rear light).

Whatever the external lighting conditions, one of the above three operating conditions therefore enables an image to be picked up from which the license plate can be reliably identified.

As regards orientation of the optical axes of digital microcameras 12, in general, various pickup configurations can be employed. To select the best, an analysis was made of the various license plate angles within the viewing frame in the travelling direction of Patrol 2, which can be grouped into the following categories, depending on orientation of the vehicles with respect to Patrol 2:

a) vehicles travelling in the same direction, in both right and left (overtaking) lanes; this situation is typical of main city streets, main roads, ring-roads and motorways, and is limited to lanes adjacent to the patrol vehicle;

b) on-coming vehicles in the opposite left-hand lane; this situation is typical of narrow two-way city streets (in historic centres);

c) parked vehicles facing in the travelling direction at the side of the road, normally on the right, but also on the left in the case of narrow, one-way roads; this situation is typical of all urban areas (main streets, side lanes, narrow streets in historic centres, etc.);

d) parked vehicles "jack-knifed" on the right and left, depending on the type of road (one- or two-way); this situation is typical of certain city streets to make the best use of available parking space, and is common in large parking areas: factories, airports, etc.; vehicle angles vary widely: at times, vehicles may be angled only slightly with respect to the travelling direction of the patrol vehicle (airport parking areas), and at others may be angled sharply (as in crowded "unauthorized" city parking areas);

e) any other possible configurations not falling within the above categories, such as randomly parked vehicles (even perpendicular to the travelling direction of the patrol vehicle) or vehicles parked on rough ground (dirt parking areas).

Figure 4:
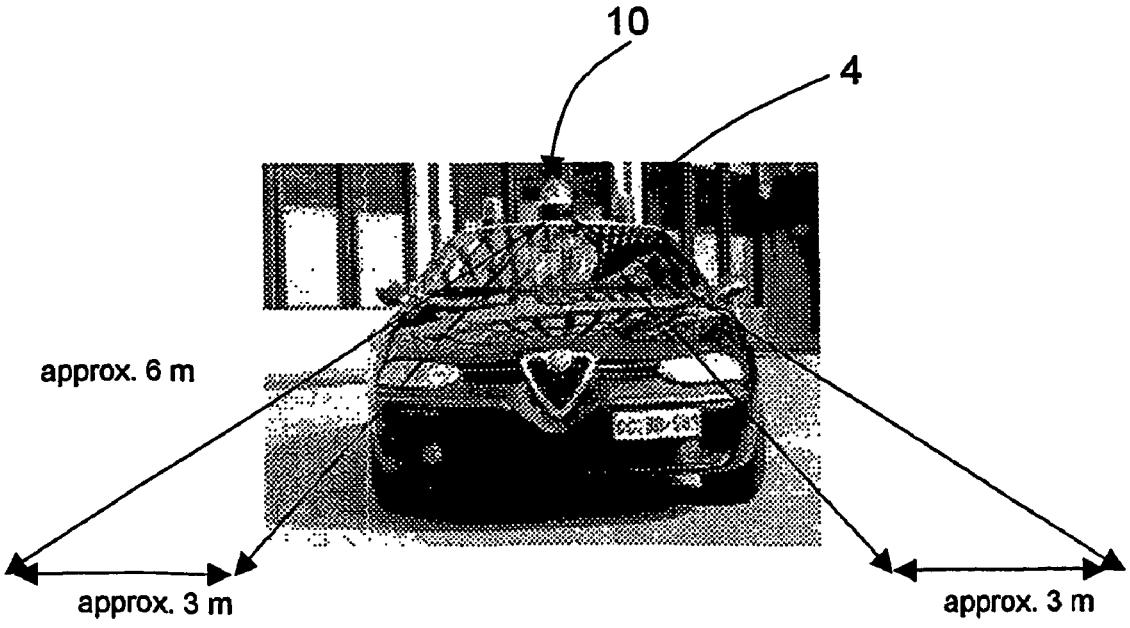
FIG. 4 shows a preferred pickup configuration of the FIG. 3 binocular sensor device.

From analysis at the test stage, a probability estimate was made of the above vehicle orientation conditions and used as a preliminary basis in selecting the pickup configuration of the license plate reading device. More specifically, the pickup configuration in FIG. 4 was selected, which represents a compromise statistically ensuring the maximum number of license plate readings at each patrol.

More specifically, in the selected pickup configuration, the optical axis of each digital microcamera 12 is located to cover a roughly three-metre lateral area of the vehicle, the focal plane of digital microcamera 12 is located roughly six metres in front of Patrol 2, and the field depth of digital microcamera 12 is roughly four metres.

With reference to FIG. 2, the on-vehicle processing unit 11 of license plate reading device 6 comprises two image acquisition and processing devices (Smart Readers) 15, each connected to a respective digital microcamera 12 to acquire the images picked up by digital microcamera 12 and extract character strings from the license plate readings; two lighting control devices 16, each connected to a respective LED lighting device 14 to time and synchronize light emission by LED lighting device 14 as described previously; a data storage device (Hard Disk) 17 for storing reading data, comprising images, license plate reading character strings, date and time, and reading georeference data from the satellite navigation system; a communication device (wireless LAN bridge) 18 for transmitting license plate readings to the Control Centre over a wireless LAN communication network and a corresponding communication device (not shown) at the Control Centre; and an Ethernet LAN network 19 connecting the various parts of on-vehicle processing unit 11.

Each license plate reading device 6 may comprise an optional third colour microcamera 20 (for this reason, shown by the dash line) installed in the passenger compartment of the vehicle, preferably on the rear-view mirror, and connected to data storage device 17 (or to an optional videorecorder in the boot of the vehicle) to videorecord particular scenes ahead of the vehicle; and a personal computer 21 connectable to Ethernet LAN network 19 for special functions.

On-vehicle processing unit 11 performs the following operations:

- continuously reads the two digital video channels from digital microcameras 12 to identify all the readable license plates in the frame at a processing rate of over 15 consecutive readings per second;
- time-integrates readings to distinguish in-transit vehicles and avoid repeatedly indicating the same license plate;
- compares recognized license plates with a wanted-plate list loaded by the Control Centre at the start of patrol and possibly updated during patrol by communication over GSM/GPRS;
- controls dialoging with on-vehicle navigation system 5 to transmit any alarms and receive georeference data relative to Patrol 2.

Performing the above functions over two independent channels (right and left microcameras) calls for considerable processing capacity combined with low consumption levels—much lower than standard industrial equipment—to avoid running down the batteries of Patrol 2.

For this reason, advanced INTEL X-Scale "embedded" technology is used, which, employing an INTEL X-Scale Integer Processor (880 MHz, 32 bits, 64 MB RAM), provides for license plate reading at video frequency, over 15 license plate readings per second, even in complex, continually varying frames; 100 Mbit/s network connection; easy remote connections for maintenance and updating; low consumption; 12-24 V supply; and exceptional compactness.

On-vehicle processing unit 11, in fact, is tantamount to a network server, in which communication with Control Centre 3 is conducted over the Wireless-LAN connection and open to developments in telecommunications technology.

With reference to FIG. 1, Control Centre 3 substantially comprises two sections or stations logically, though not necessarily, physically separate and communicating over a LAN network; a patrol radio-location station 22 for locating by radio and communicating with Patrols 2 via a GSM/GPRS module 23; and a license plate control station 24 for updating the wanted-plate list, for gathering, filing and consulting the license plates picked up by Patrols 2, and for handling Patrol-generated alarms.

A database of license plates gathered and memorized during previous patrols can be consulted at any time by Control Centre 3 personnel for various purposes:

- to look up a license plate on the basis of a complete string or partial data, to determine where and when it was reported; the resident program at the license plate control station employs a map system to enable the operator to graphically locate the area in which a license plate was reported by simply selecting the desired in-transit vehicle. License plate control station 24 also provides for displaying an image of the vehicle corresponding to the identified plate, and for indicating the pickup site on the map, complete with image zooming and enhancement;
- to review alarm images to check they are correct and determine, if possible, the type of vehicle reported;
- to update the wanted-plate list by adding or deleting strings/plates, and possibly entering comments on the type of alarm (stolen car, under investigation, etc.).

Consultation of the database is restricted by password to authorized personnel only.

Operation of the territorial surveillance and security control system according to the present invention will now be described with particular reference to user operation.

1. Loading Data and Wanted-Plate Lists

This is done at Control Centre 3 by a processing station (PC) equipped with software and a user interface for updating and consulting the license plate database. Data exchange between Control Centre 3 and Patrols 2 is over a wireless LAN connection—shown schematically in FIG. 1 by 25—in an appropriate exchange area, e.g. inside a police garage or workshop, to minimize labour and make data exchange as automatic as possible.

2. Patrol Start-up

Starting up car 4 calls for no additional work on the part of patrol personnel, all data being updated fully automatically over wireless LAN connection 25. Once the updated wanted-plate data is received from Control Centre 3, the system is ready and patrolling can commence.

When turned on, license plate reading device 6 communicates its status to on-vehicle navigation system 5, which displays it on its own on-vehicle display by means of an appropriate icon (e.g. a green traffic-light).

License plate reading device 6 and on-vehicle navigation system 5 continually check correct operation and indicate any malfunctions.

From this point on, license-plate reading device 6 reads and memorizes any license plates encountered enroute.

3. On-patrol License Plate Reading

On patrol, the user transmits and receives messages to and from Control Centre 3 over on-vehicle navigation system 5. In addition to the standard services provided by on-vehicle navigation system 5, the following are also available:

license plate reading device 6 memorizes data relative to vehicles travelling in the right and left lanes with respect to the travelling direction of the patrol vehicle. The string corresponding to the last license plate reading from each digital microcamera 12 is updated continually on the on-vehicle navigation system 5 display, and appears on the right or left of the display, depending on which digital microcamera 12 it refers to, so as to enable the operator to check operation of license plate reading device 6;

in-transit data is recorded by license plate reading device 6, and contains the detected license plate string, the image (compressed or not) of the in-transit vehicle, and the date, time and location (georeferenced data from the on-vehicle navigation system);

when a wanted plate is detected, license plate reading device 6 displays it on the on-vehicle navigation system display;

an alarm signal is transmitted automatically in real time to control Centre 3 by on-vehicle navigation system 5 over GSM/GPRS module 7; in the event of failure to transmit the alarm signal to Control Centre 3, on-vehicle navigation system 5 displays a fail message; and a marker is automatically shown on the on-vehicle navigation system 5 display map to indicate the pickup location of the license plate in question;

via GSM/GPRS module 23, Control Centre 3 can also supply on-vehicle navigation system 5 with additional plates to check or to add to the existing on-vehicle list, even while on patrol; these new data strings are entered by a resident program, at license plate control station 24, connected to the radio-location system and designed to transmit data to all the mobile surveillance units; on receiving a message from Control Centre 3 containing a new plate to check, on-vehicle navigation system 5 transmits the relative string to on-vehicle processing unit 11, which enters the plate on the check plate list.

4. Re-entry

Upon re-entry of Patrol 2, license plate reading device 6 provides automatically for transferring all the data picked up on patrol by Patrol 2 (e.g. license plate reading list, digital images, alarm list, etc.) to Control Centre 3 over wireless LAN connection 25, for shutting down the system, and for cutting off its own power supply.

Field tests conducted by the Applicant to compare the number of license plate readings by Patrol 2 equipped with license plate reading device 6, with the number of supposedly "readable" plates counted personally by a patrol member seated next to the driver (concealed-vehicle plates outside the frame of the microcameras were not counted as "readable"), showed the system to have a reading percentage of over 80%. The reduction in performance between night-time and day-time readings is negligible and less than 5%. Night-time images, in fact, are only inadequate in the case of very dirty or deteriorated plates. Otherwise, the infrared LED's provide for even better images than in daytime, by greatly attenuating any objects in the frame which, unlike license plates, are not retroreflective. No noticeable reduction in performance was recorded in rainy or overcast weather conditions, which in fact even make for more uniform images, comparable to twilight or night-time readings.

Clearly, changes may be made to the system as described and illustrated herein without, however, departing from the scope of the present invention as defined in the accompanying Claims.

In particular, the system may be used for applications other than the one (security) described, i.e. detecting data relative to (stationary/moving) vehicle license plates for security reasons, or for locating, by generating automatic alarms, "suspect" vehicles, e.g. stolen or owned/used by individuals sought after, under investigation, or wanted, etc. by the police.

The (surveillance) system can also be used locally to control authorized vehicles in limited-traffic areas (LTA), e.g. in historic town centres. In which case, alarms may be generated upon automatically detecting license plate numbers not listed as being authorized to circulate in such areas.

The invention claimed is:

1. A territorial surveillance and/or security control system based on monitoring vehicle license plates, characterized by comprising:

at least one mobile surveillance unit (2) for automatically reading license plates of stationary and moving vehicles, and for immediately generating alarms during patrol by the mobile surveillance unit (2); said alarms being generated by immediately and instantaneously comparing detected license plates with a list of wanted license plates available on said mobile surveillance unit; and a permanent surveillance centre (3) communicating with the mobile surveillance unit (2) to locate the mobile surveillance unit by radio, to gather, file, and consult the license plates detected by the mobile surveillance unit (2), and to handle the alarms generated by the mobile surveillance unit; said permanent surveillance centre being responsible for updating the list of wanted license plates and transmitting it to the mobile surveillance unit.

2. A system as claimed in claim 1, characterized in that the mobile surveillance unit (2) comprises:

a vehicle (4) equipped with an on-vehicle navigation system (5); and a license plate reading device (6) on the vehicle (4) and communicating with the on-vehicle navigation system (5) of the vehicle (4); the on-vehicle navigation system (5) controlling communication with the permanent surveillance centre (3) to transmit any alarms generated by the mobile surveillance unit (2).

3. A system as claimed in claim 2, characterized in that the license plate reading device (6) comprises:

a sensor device (8) for picking up the vehicle license plates; and an on-vehicle processing unit (11) connected to the sensor device (8) to read and memorize the license plates picked up by the sensor device (8).

4. A system as claimed in claim 3, characterized in that the sensor device (8) comprises:

at least one camera (12) for picking up vehicle license plates; and a lighting device (13) combined with the camera (12) to ensure clear pickup and reading of images in any external lighting condition.

5. A system as claimed in claim 4, characterized in that the lighting device (13) is a LED lighting device operating in pulsed mode and synchronized with the camera (12).

6. A system as claimed in claim 4, characterized in that the lighting device (13) generates a light beam in the close to infrared spectrum to limit interference by ambient light.

7. A system as claimed in claim 4, characterized in that the on-vehicle processing unit (11) comprises:

an image acquisition and processing device (15) connected to the camera (12) to acquire the images picked up by the camera, and to extract character strings of the detected license plates;

a lighting control device (16) connected to the lighting device (13) to time and synchronize light emission by the lighting device; and a data storage device (17) for storing character strings of the detected license plates, together with associated geo-reference data supplied by the on-vehicle navigation system (5).

8. A system as claimed in claim 7, characterized in that the sensor device (8) comprises:

two cameras (12) for picking up license plates of vehicles to the right and left respectively of the mobile surveillance unit (2); and two lighting devices (13), each associated with a respective camera (12).

9. A system as claimed in claim 1, characterized in that the permanent surveillance centre (3) comprises:

a radio-location station (22) for locating by radio and communicating with the mobile surveillance unit (2); and a license plate control station (24) connected to the radio-location station (22) to gather, file, update, and consult the license plates detected by the mobile surveillance unit (2), and to handle any alarms generated by the mobile surveillance unit.

10. A system as claimed in claim 1, characterized by also comprising:

first communication means (7, 23) enabling communication between the permanent surveillance centre (3) and the mobile surveillance unit (2) on patrol; and second communication means (18, 25) enabling communication between the permanent surveillance centre (3) and the mobile surveillance unit (2) at the start and end of patrol.

11. A system as claimed in claim 10, characterized in that the first communication means comprise telephone communication means (7, 23) employing a mobile telephone network; and the second communication means comprise wireless communication means (18) employing a wireless LAN network (25).

* * * * *